US005181641A

United States Patent [19]

Ferguson

[11] Patent Number: 5,181,641

[45] Date of Patent: Jan. 26, 1993

[54] TRACTOR FEED FOR PERFORATED WEBS

[76] Inventor: Gregory A. Ferguson, 3146 Acushnet Ave., New Bedford, Mass. 02745

[21] Appl. No.: 762,815

[22] Filed: Sep. 17, 1991

[51] Int. Cl.[5] ..... B65H 20/20

[52] U.S. Cl. ..... 226/74; 400/616.1

[58] Field of Search ..... 226/74, 75, 170, 171, 226/86; 400/616.1, 616.2; 474/185, 154, 179

[56] References Cited

U.S. PATENT DOCUMENTS

| | | | |
|---|---|---|---|
| 3,693,856 | 9/1972 | Funk | 226/74 |
| 3,825,162 | 7/1974 | Hubbard | 226/74 |
| 3,958,735 | 5/1976 | Wanat | 226/1 |
| 3,982,677 | 9/1976 | Letz | 226/75 |
| 4,129,239 | 12/1978 | Hubbard | 226/75 |
| 4,160,606 | 7/1979 | Caenazzo | 400/616.2 |
| 4,206,859 | 6/1980 | Plaza | 226/74 |
| 4,316,567 | 2/1982 | Grear et al. | 226/74 |
| 4,345,708 | 8/1982 | Hubbard | 226/74 |
| 5,022,578 | 6/1991 | Ohsaki | 226/74 |

FOREIGN PATENT DOCUMENTS

| | | |
|---|---|---|
| 1229552 | 12/1966 | Fed. Rep. of Germany . |
| 2062806 | 7/1972 | Fed. Rep. of Germany . |

*Primary Examiner*—Daniel P. Stodola
*Assistant Examiner*—Paul T. Bowen

[57] ABSTRACT

A tractor feed mechanism combines, in a unitary assembly, components which provide the capabilities of separate, independent, left and right-hand tractors and their support and drive shafts. The assembly has fewer parts than a tractor feed using separate tractors thereby reducing the cost and increasing the reliability of the feed mechanism. In the unitary tractor feed, endless tractor belts are positioned by lid belt guide members which are slidable on a bar having a surface which provides a platform which sets the height of the belts, while the web is disposed on a gap between an upwardly facing surface of the guide members and a downwardly facing surface of the lid. The bar and a sprocket which engages the belt extends laterally (width-wise) of the web a distance at least as wide as the longest web to be fed. The guide members contain flexural fingers providing detents which are cammed into locking engagement against the bar when the lid is closed; allowing, when the lid is opened, the detent to spring away from the bar so that the guide members can be moved to align the belts guided therein with the perforations in the web.

11 Claims, 5 Drawing Sheets

TRACTOR FEED FOR PERFORATED WEBS

DESCRIPTION

The present invention relates to apparatus for feeding perforated webs, and particularly to a perforated document tractor feed mechanism.

The invention is especially suitable for use in printers which print lines, usually under computer control, across a document which is part of a continuous web which may be fan folded or unreeled from a supply roll. When so used the invention provides a tractor feed which may be installed in the framework of the printer as a unitary assembly having tractor belts, a unitary drive sprocket or gear in engagement with drive elements on the belt (sometimes called teeth which extend inwardly from the inside of the belt) and a unitary bar which provides support for members which are adjustably positionable width-wise of the web and carry the belt into alignment with perforations on the document. Gears and other drives are connected to the sprocket for moving the belt to feed the document as successive lines are printed on the document.

Conventional tractor feeds such as shown in U.S. Pat. No. 4,345,708 issued Aug. 24, 1982 to L. J. Hubbard and U.S. Pat. No. 3,825,162 issued Jul. 23, 1974 also to L. J. Hubbard utilize pairs of fully assembled tractors mounted on drive shafts and support shafts. These tractors, which are called left hand and right hand tractors, are in mirror-image relationship and have belts from which pins extend upwardly into engagement with perforations on the web and drive elements (rollers or teeth) projecting inwardly from the inside of the belt. These belts are located in frames (sometimes called cages—see U.S. Pat. No. 4,160,606 to Caenazzo issued Jul. 10, 1979) having support surfaces on which the drive elements of the belt bear and surfaces spaced from the support surfaces on the side frames on which the paper is supported in a gap between the underside of a lid and the paper support surfaces of the frame. There are drive sprockets and there may be idler sprockets (both sometimes called gears) in journals or bearings mounted in the frames. The support shafts extend through these idler sprockets, and may alternatively extend through clamping devices also mounted in the frames of each tractor for clamping the tractors at positions spaced width-wise of the document (axially of the shafts) to align the pins on the belts with the perforations in the paper and then lock the tractors in place. See U.S. Pat. No. 4,129,239 issued Dec. 12, 1978 to L. J. Hubbard; U.S. Pat. No. 3,693,856 issued Sep. 26, 1972 to J. W. Funk; and U.S. Pat. No. 3,982,677 issued Sep. 28, 1976 to G. H. Letz. The following patents may also be referred to for further information regarding conventional dual tractor drives for feeding perforated documents or other record materials and clamping mechanisms thereof. U.S. Pat. No. 3,958,735 issued May 25, 1976 to Wanat; U.S. Pat. No. 4,206,859 issued Jun. 10, 1980 to Plaza; U.S. Pat. No. 4,316,567 issued Feb. 23, 1982 to Grear; and German Patent Documents 1,229,562 published Dec. 1, 1966 and 2,062,806 published Jul. 6, 1972.

While such tractor feeds have been successfully used for many years in computer printers and elsewhere for driving perforated webs, the cost of such drives has been difficult to reduce because of the need for substantially identical, independent tractor units for driving the left and right hand perforations of the document, and the need for precision drive and support shafts. The use of individual sprockets or drive gears is also a factor limiting cost and requiring careful design. Such gears can be responsible for backlash and runout because of cumulative tolerances in the dimensions of the gears and the journals supporting them and the tolerance of the intermeshing belt drive elements and sprocket or gear teeth. Bearing wear is also a factor limiting precision of web feed. Also when left and right hand tractors are used, phasing (rotational misalignment) of the teeth on the sprockets is needed to align the pins in the length-wise direction (along the rows of perforations) so as to prevent damage to the perforations. The sprockets or gears also increase the torque requirements on the drive system (the drive motor and its transmission, a gear train or belts and pulleys).

It is the principal object of the present invention to provide an improved tractor feed mechanism for feeding perforated webs which substantially eliminates the limitations on cost reduction which are applicable to tractor drives using independent tractors in pairs mounted on drive and support shafts.

It is a still further object of the present invention to provide an improved tractor feed mechanism having a sprocket of length sufficient to drive a pair of belts and which eliminates the need for separate sprockets each in their own journal or bearing.

It is a still further object of the present invention to provide an improved tractor feed mechanism wherein a unitary bar extending laterally and along the axis of a unitary drive sprocket which drives a pair of tractor belts provides structural integrity to the mechanism by supporting belt and web guide members which may be locked to the bar when the members are adjusted to bring the belts into alignment with the rows of perforations on the web to be fed.

It is a still further object of the present invention to provide an improved tractor feed mechanism having a bar extending laterally, width-wise of the web to be driven, which supports members for guiding each of a pair of tractor belts and having a locking mechanism operated by the tractor lid when closed for positively and directly locking the guide members to the bar when adjusted to positions where the pins on the belts are in alignment with the rows of perforations on the web.

Briefly described, a unitary feed mechanism, for feeding a web having two rows of perforations in the length-wise direction but spaced from each other width-wise of the web, has a pair of endless belts with pins spaced to enter into the perforations and with drive elements; the drive elements and pins respectively projecting inwardly and outwardly from opposite sides of the belts. A bar having a surface providing a support platform for the drive elements extends in the width-wise direction a distance sufficient to accommodate the widest web to be fed by the mechanism. A sprocket having teeth spaced peripherally thereof, between which slots for receiving the drive elements are disposed, also spaced peripherally about the sprocket, extends in the width-wise direction across the web. The sprocket and bar are disposed inside of the belts. The drive elements are in the slots of the sprocket and are also supported on the support platform provided by the bar. A pair of web and belt guide members are movably disposed on the bar. These members have slots, extending in the direction in which the web is fed, in which the belts are received and guided as they are driven by the sprocket. The drive elements are also located on the support platform of the bar and are spaced outwardly from surfaces of the guide members on which the web is disposed the pins on the belt extending outwardly and enter the perforations because of the relative height of the pins with respect to the distance between the support platform of the bar on which the belt bears and the surfaces of the members on which the web bears. Mechanisms, for locking the guide members to the bar adjustably width-wise of the web's path for alignment of the pins on each belt with the perforations in the web, utilize flexible fingers which form detents engagable with the tractor bar, preferably with teeth of serrations spaced from each other along the width of the web so as to prevent width-wise movement when the members are in locked position. Lids 108 are pivotally mounted on the guide members 94 and 96 and have cams which engage the detents to release them from the bar or to force the detents against the bar when the lids are closed (and into the spaces between the teeth formed on the bar). Thus, a unitary tractor feed is provided which can be installed in a printer frame between lateral walls to which opposite ends of the bar are connected and in which the sprocket is journalled and can be engaged in driving relationship with a gear or other drive transmission which turns the sprocket to motivate the belt directly without backlash and part runout and with less torque or tolerance buildup than is the case with independent tractors having independently journalled gears or sprockets for driving the belts thereof. The unitary structure also enables the tractor belts to be positioned along the single sprocket to control the motion of the web both laterally and inwardly and outwardly (vertically) by virtue of the locking lid thereon.

The foregoing and other objects, features and advantages of the invention will become more apparent from a reading of the following description in connection with the accompanying drawings in which.

Figure 1:
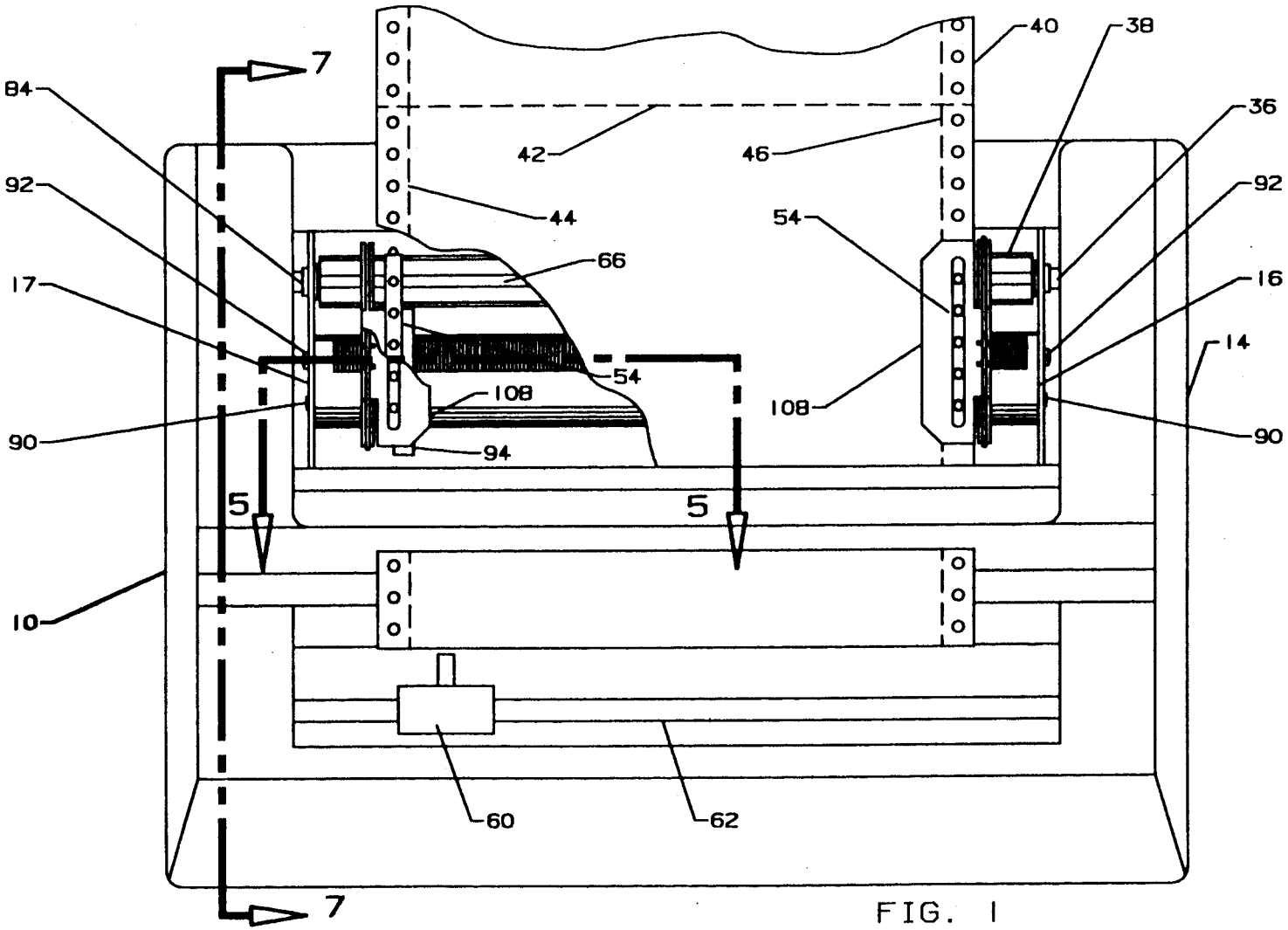
FIG. 1 is a plan view of a printer embodying a tractor feed mechanism provided in accordance with a presently preferred embodiment of the invention, the paper (the web) fed by the mechanism through the printer being broken away to illustrate the mechanism and a lid on one of the belt and web guide members being broken away to illustrate the construction of that member below the lid.
Figure 3:
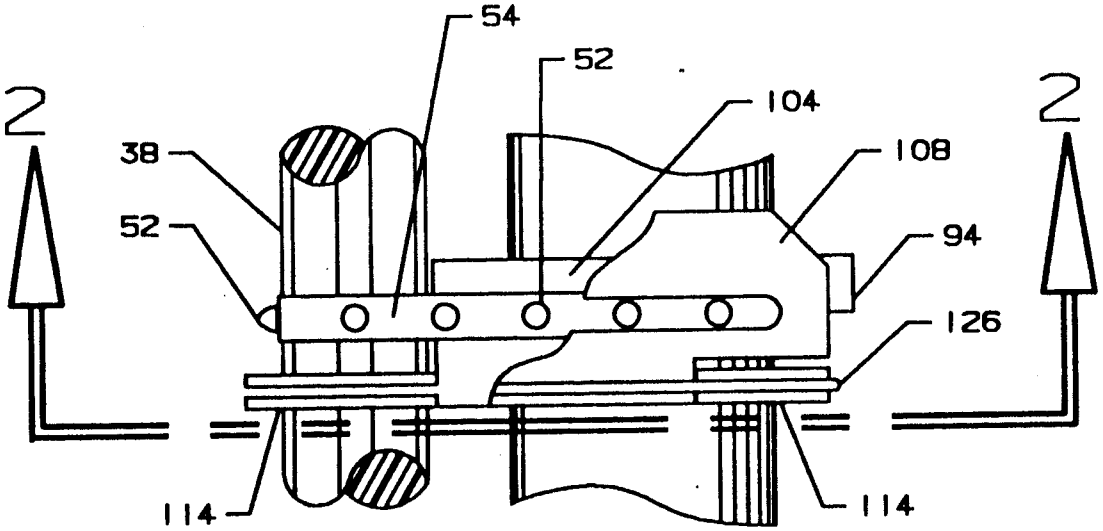
FIG. 3 is an enlarged fragmentary plan view of the mechanism illustrating one of the guide members.
Figure 4:
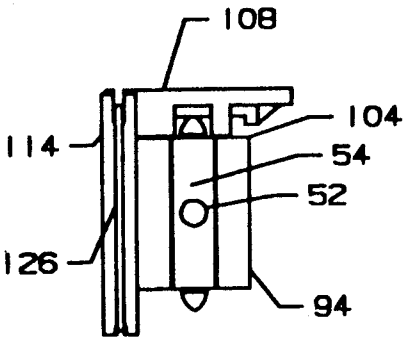
FIG. 4 is an end view of the guide member shown in FIG. 3 taken from the right as viewed in FIG. 3.
Figure 2:
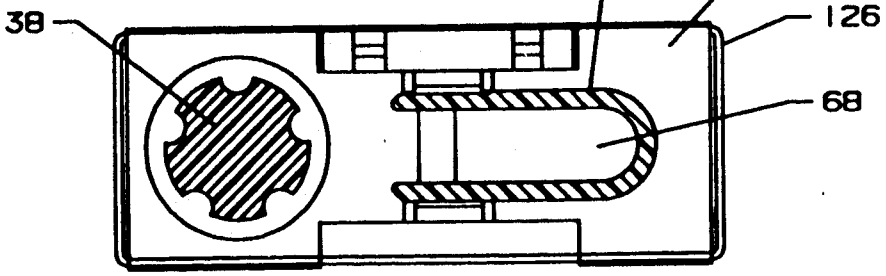
FIG. 2 is a fragmentary, sectional view of the tractor feed mechanism taken along the line 2-2 in FIG. 3.
Figure 7:
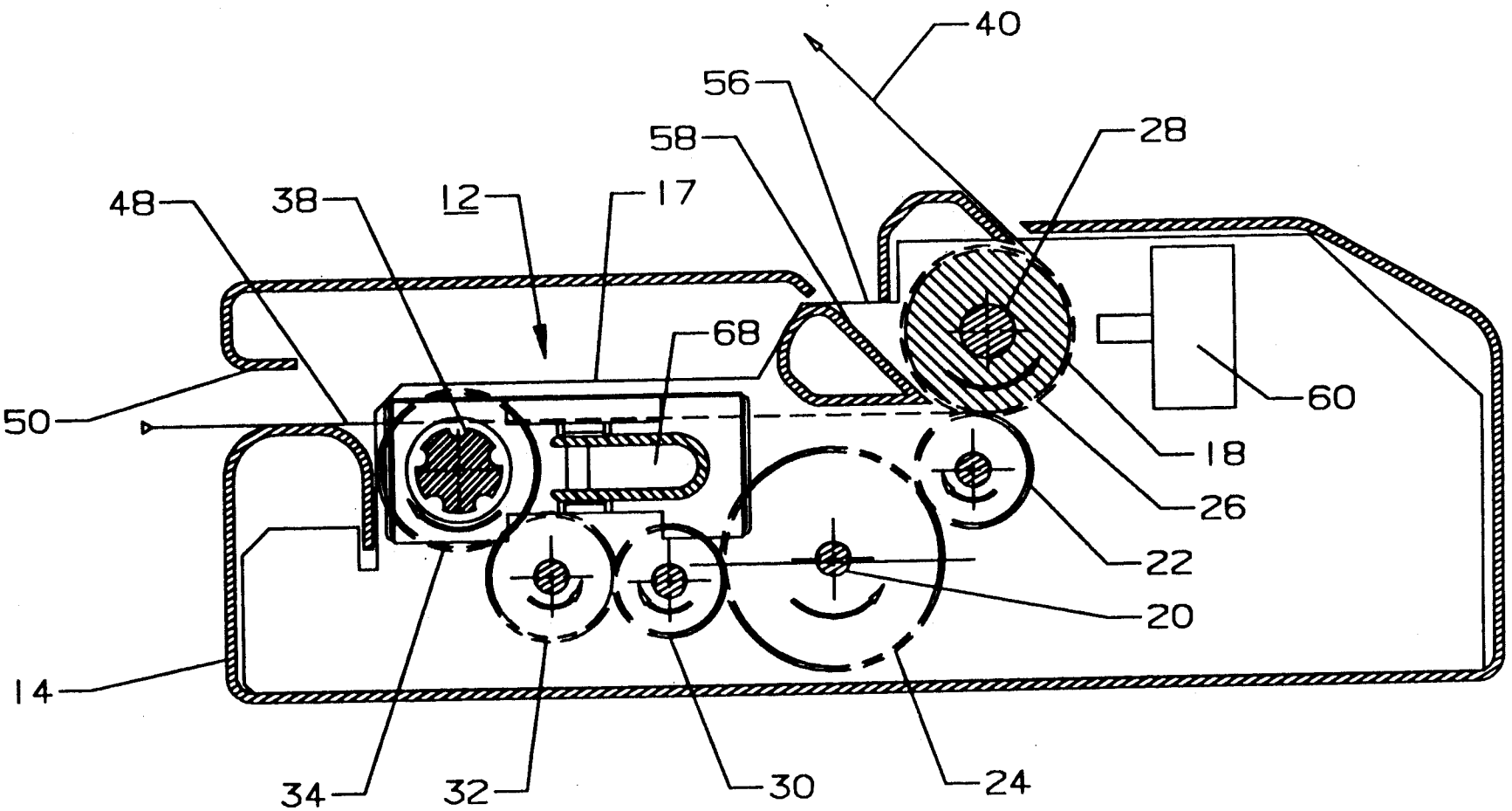
FIG. 7 is a sectional view of the printer shown in FIG. 1, the view taken along the line 7—7 in FIG. 1.

Referring to the drawings, there is shown in FIGS. 1 and 7 a printer 10 having a tractor feed mechanism 12 provided in accordance with the presently preferred embodiment of the invention. The printer also has a housing 14 having an internal framework of side plates 16 and 17. As shown in FIG. 7, a platen roller 18 is journalled between these side plates and is driven from a motor (usually a stepping motor), the shaft 20 of which is shown in FIG. 7, via a spur gear 22, a drive gear 24 on the motor shaft and a gear 26 on the platen shaft 28 which is driven by the motor through the gears 22 and 24. The tractor feed mechanism 12 is also driven by the motor via spur gears 30 and 32 and a driven gear 34 which is connected to a stub shaft 36 (see FIG. 8) extending from one end of the sprocket 38 of the tractor feed mechanism 12.

The web 40 (edge perforated paper of the type which is conventionally used in computer printers) has horizontal or width-wise scoring 42 and length-wise scoring 44 and 46 so as to enable successive sheets of the continuous (which can be fan-folded) paper 40 to be separated at the horizontal scoring 42 and the perforated area is separated from the sheets at the scoring 44 and 46. The paper is fed along a horizontal path 48 into an end slot 50 into the housing 14. The paper then passes the tractor feed mechanism 12 where the upwardly extending pins 52 from the tractor belts 54 enter the perforations in the paper 40. The paper is driven by the mechanism 12 and is taken up by the platen 18 and fed out of the printer housing 14. There is an alternate opening 56 for sheet fed paper documents around a deflector 58. When sheets are fed, the tractor mechanism is not used. Then, pressure plates may be associated with the platen to hold the paper in engagement therewith. As the paper passes around the platen it is impacted by a print head 60 which is driven on a guide bar 62 along a horizontal line across the paper where it impacts the paper so as to print characters on the paper a line at a time. The print head and the mechanism and system for operating same may be conventional.

The drive mechanism 12 utilizes a pair of belts 54 with pins 52 and drive elements 64 extending from the inside and outside of the belt. The drive element 64 and the design of the belt is discussed in the above-identified patents issued to L. J. Hubbard, especially U.S. Pat. No. 3,825,162. Other types of belts, generally known as pin tractor belts, having pins and drive elements in the form of teeth on a band of elastomeric material may also be used. The slots 66 in the sprocket 38 are shaped to conform with the shape of the drive element teeth.

The slots 66 extend width-wise of the web a distance equal to the width of the widest web to be handled in the printer. FIG. 1 shows that the sprocket 38 and the slots 66 therein are longer than the width of the paper 40. Thus, somewhat wider and, of course, narrower paper than shown may be used in the printer equipped with the tractor feed mechanism 12. The belts 54 are disposed with a plurality of the drive elements thereof in engagement in the slots 66 of the sprocket. The sprocket defines one end of the path of the belt. Adjacent to the sprocket, and arranged so that the pitch line of the belt is tangent to the outer periphery of the sprocket 38, is a bar 68. This bar has a surface 70 against which the belt bears on the inside thereof by virtue of the drive element 64 resting on a platform defined by the surface 70. The bar 68 has a curved edge 72 which defines the opposite end of the belt's path (opposite from the end defined by the sprocket 38). The upper side of the surface 70 has an area extending width-wise of the web (laterally of the bar 68) of serrations or teeth 74 (see especially FIGS. 5 and 6). These serrations run length-wise of the web and serve as part of the locking mechanism which locks the belts into aligned position with the edge perforations of the web 40.

Figure 8:
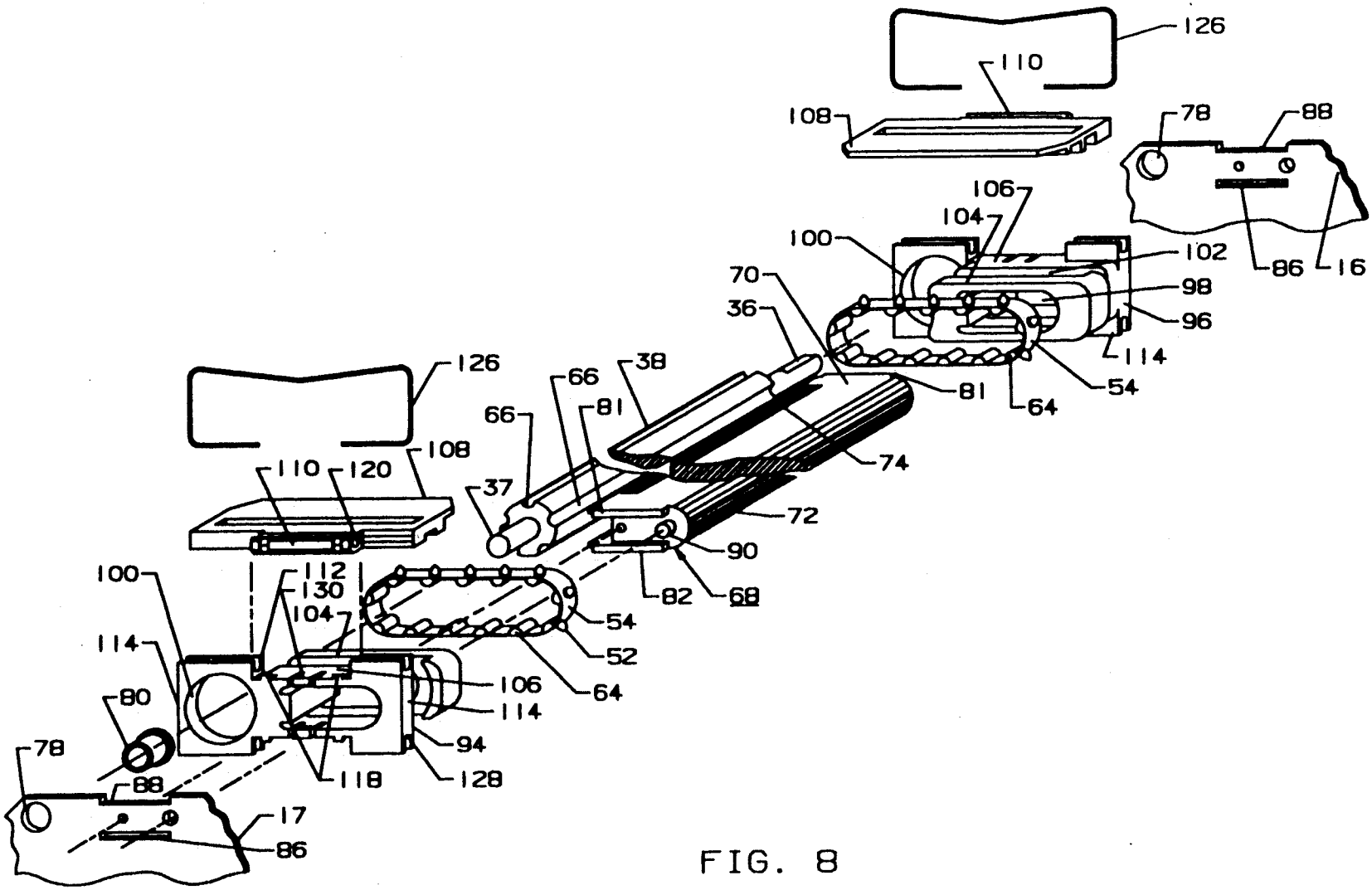
FIG. 8 is an exploded, perspective view of the tractor feed mechanism.

Part of the frame plates 16 and 17, which may be separate brackets, support the opposite ends of the sprocket 38 and the bar 68. As shown in FIGS. 1 and 8 stub shafts 36 and 37 on opposite ends of the sprocket extend through openings 78 after passing through collars 80 which may be held in position by C-washers 84, thus preventing axial movement of the sprocket. The bar 68 has tabs 82 and 81 which enter slots 86 and notches 88 in the plates 16 and 17. A boss 90 facilitates assembly of the mechanism in the plates 16 and 17. The bar may be fastened in place using screws 92 (see FIGS. 1, 7 and 8).

Slidably disposed for width-wise movement with respect to the bar 68 and the sprocket 38 are belt and web guide members 94 and 96. These members have openings 98 and 100 through which the sprocket 38 and bar 68 extend. The members are preferably molded from one piece of plastic material and have slots 102 extending in the length-wise direction from surfaces 104 and 106 which are in horizontal alignment and on which the web is guided. These surfaces define, with the bottom surface 111 of lids 108 a gap 113 through which the paper passes when the lids 108 are closed.

The lids have ears 110 which are disposed in notches 112 in the outside wall 114 of the members 94 and 96. Each of the ears defines an edge 115 which is chamfered and about which the lid is pivotal on the guide members 94 and 96 and particularly on the bottom of the slots 112 thereof. The bottoms of the slots may be ramped in part as shown at 118 to facilitate the pivoting thereof. The lids have a slot 120 extending parallel to an end face 122. This is a blind slot which is spaced from a surface 124 perpendicular to the end surface 122 which is stepped outwardly away from the surface 111 of the lid which defines the gap 113 so as to set the height (in a direction above the surfaces 104 and 106) of the gap 113.

Holding the lid on the member and attaching it pivotally thereto are generally rectangular hair pin springs 126. These springs 125 are captured in slots 128 in the top and bottom edges of the walls 114.

Figure 6:
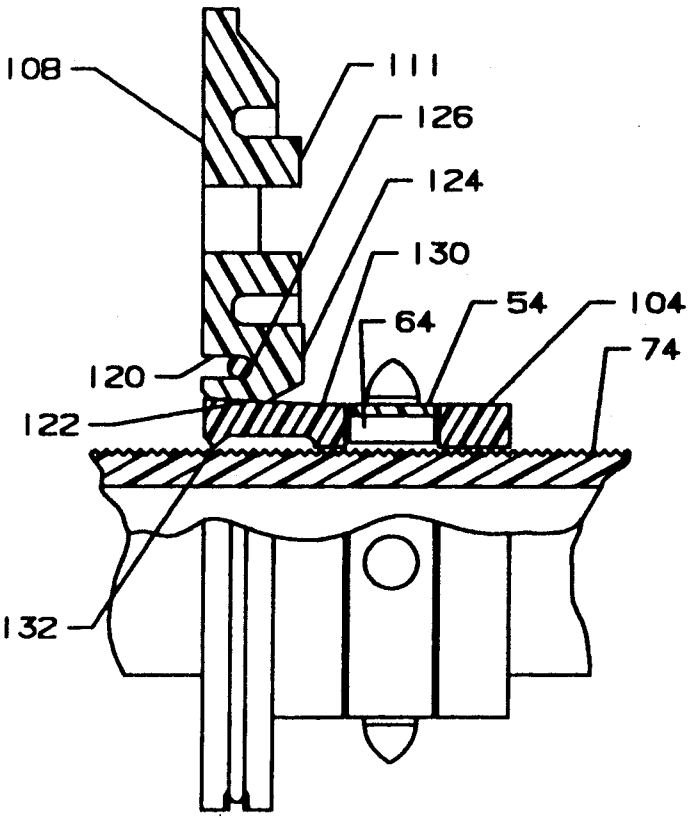
FIG. 6 is a view similar to FIG. 5 with the guide member in unlocked position.
Figure 5:
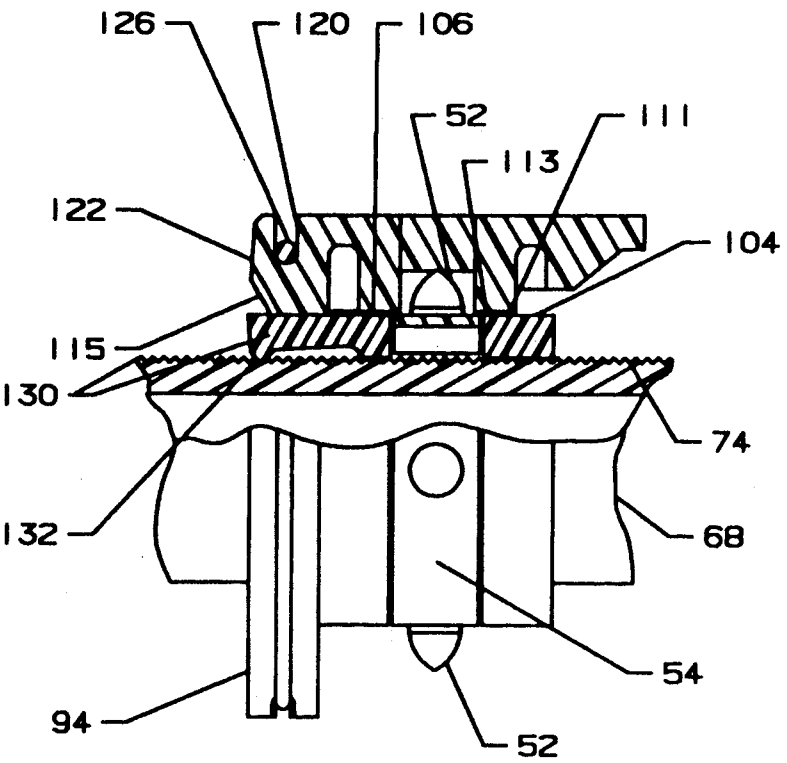
FIG. 5 is a fragmentary sectional view showing the locking mechanism of the tractor feed mechanism, the view taken along the line 5—5 in FIG. 1.

As shown in FIGS. 5 and 6, the surface 122 is closer to the side of the slot than the surface 124. Accordingly, when the lid is in closed position, the surface 124 bears against a finger 130 having a tooth 132; camming that detent downwardly to bring the tooth into a space between the serrations 74. The members are, therefore, locked to the bar 68 when the lid is closed. When the lid is open, the space between the side 122 and the slot 120 is shorter in height and allows the detent to spring upwardly to the position shown in FIG. 6. Then the guide members can be adjusted width-wise so as to bring the belts 54 and their pins 52 into alignment with the perforations on the web 40. A positive and direct locking mechanism is, therefore, provided as part of the tractor feed mechanism 12.

Since the mechanism requires less torque, by virtue of increased sprocket diameter, the sprocket and its stub shafts can be molded out of plastic, for example polycarbonate or even ABS. The bar 68 and the guide members 94 and 96 can also be made from plastic. The only metal parts need be the springs 126, the collar 80 and its clamp ring 84 and the screws 92. This further facilitates the cost reduction of the tractor mechanism.

From the foregoing description, it will be apparent that there has been provided an improved tractor mechanism adapted to be cost reduced for use in printers of low cost, thereby providing a convenient and effective tractor drive therein. Variations and modifications in the herein-described tractor mechanism, within the scope of the invention, will undoubtedly suggest themselves to those skilled in the art. For example, one of the guide members may be fixed while the other is movable with respect thereto. Accordingly, the foregoing description should be taken as illustrative and not in a limiting sense.

What is claimed:

1. A unitary tractor feed mechanism for feeding a web in a direction length-wise thereof, said web having two rows of perforations in the length-wise direction spaced from each other width-wise of the web, said mechanism comprising a pair of endless belts with pins spaced to enter said perforations and drive elements, said pins and drive elements respectively projecting outwardly and inwardly from opposite sides of said belts, a single element consisting of a bar having a surface providing a support platform for said drive elements and extending in a width-wise direction a distance at least equal to the width of the web, a sprocket having teeth spaced peripherally thereof between which slots for receiving said drive elements are disposed also spaced peripherally about said sprocket between said teeth thereon, said sprocket also extending in the width-wise direction, said sprocket and said bar being disposed within the insides of said belts with said drive elements received in said slots and also bearing on said support platform of said bar, a pair of web and belt guide members adjustably spaced from each other width-wise of said web and disposed on said bar, said members having slots therein extending in a direction length-wise of said web in which slots said belts are located with said drive elements on said support platform of said bar, said slots extending inwardly from surfaces of said members on which said web is disposed with said pins extending outwardly into said perforations, said surfaces of said members thereby guiding said web at a distance spaced vertically from said support platform of said bar with said pins extending outwardly into said perforations.

2. The mechanism according to claim 1 wherein one of said bar and said members having openings in which the other is slidably received for positioning said members closer or farther from each other to move said belts in said width-wise direction with respect to each other to bring said pins thereof into alignment with said rows of perforations.

3. The mechanism according to claim 2 wherein means are provided carried by said members for locking them to said bar when positioned to provide said alignment of said pins with said rows of perforations.

4. The mechanism according to claim 2 wherein said members have opening through which said bar and said sprocket extend and are disposed in slidable relationship with said bar in the width-wise direction along said bar and said sprocket so that said drive elements remain engaged with said slots in said sprocket and remain supported by said surface of said bar.

5. The mechanism according to claim 4 further comprising plates disposed at opposite ends of said bar in which said sprocket is journalled at the opposite ends thereof and to which said bar is connected.

6. The mechanism according to claim 2 wherein said members are each one piece of material, and lids pivotally connected to said members.

7. The mechanism according to claim 6 wherein said bar, said sprocket, said members and said lids are of plastic material.

8. The mechanism according to claim 1 wherein said sprocket, like said bar, is a single element which extends in the width-wise direction a distance at least equal to the width of said web, and said slots and teeth extend over all of said distance in said width-wise direction.

9. A tractor feed mechanism for feeding a web in a direction length-wise thereof, said web having two rows of perforations in the length-wise direction spaced from each other width-wise of the web, said mechanism comprising a pair of endless belts with pins spaced to enter said perforations and drive elements, said pins and drive elements respectively projecting outwardly and inwardly from opposite sides of said belts, a bar having a surface providing a support platform for said drive elements and extending in a width-wise direction a distance at least equal to the width of the web, a sprocket having teeth spaced peripherally thereof between which slots for receiving said drive elements are disposed also spaced peripherally about said sprocket between said teeth thereon, said sprocket also extending in the width-wise direction, said sprocket and said bar being disposed within the insides of said belts with said drive elements received in said slots and also bearing on said support platform of said bar, a pair of web and belt guide members adjustably spaced from each other width-wise of said web and disposed on said bar, said members having slots therein extending in a direction length-wise of said web in which slots said belts are located with said drive elements on said support platform of said bar, said slots extending inwardly from surfaces of said members on which said web is disposed with said pin extending outwardly into said perforations, said surfaces of said members thereby guiding said web at a distance spaced vertically from said surface of said bar with said pins extending outwardly into said perforations, means carried by said members for locking them to said bar when positioned to provide said alignment of said pins with said rows of perforations, said members each having a lid having an inside surface, each of said lids being pivotable on its respective one of said members from an open position away from said surfaces of said members on which said web is disposed to a closed position to provide a gap between the inside surface of each of said lid and said surfaces of said members on which said web is disposed through which said web is fed, and detents on said members engagable by said lid thereon and movable against said bar into locking relationship therewith when said lid is pivoted to its closed position.

10. The mechanism according to claim 9 wherein said bars have serrations extending length-wise and spaced side-by-side across the width of said bar, said detents each having a tooth extending in the length-wise direction to engage said bar between said serrations when said lids are in closed position.

11. The mechanism according to claim 9 wherein each of said lids has an end with an edge between a first surface transverse to said surface of said lid which defines said gap and a second surface of said lid generally paralleling said gap-defining surface, a slot extending into said lid from a surface thereof opposite to said second surface and spaced closer to said first surface than to said second surface, a hair pin spring in said slot biasing said lid against said member, said edge defining a pivot about which said lid is pivotable to bring said first surface against said detent when said lid is open position and said second surface against said detent when said lid is in closed position to move said detent respectively out of an interlocking position against said bar.

* * * * *